US008876244B2

(12) United States Patent
Kasiske, Jr. et al.

(10) Patent No.: US 8,876,244 B2
(45) **Date of Patent: *Nov. 4, 2014**

(54) INKJET PRINTING SYSTEM WITH CONDENSATION CONTROL SYSTEM

(75) Inventors: W. Charles Kasiske, Jr., Webster, NY (US); John Leonard Hryhorenko, Webster, NY (US); Timothy John Hawryschuk, Miamisburg, OH (US); Alan Earl Rapkin, Pittsford, NY (US); Andrew Ciaschi, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 247 days.

This patent is subject to a terminal disclaimer.

(21) Appl. No.: 13/461,827

(22) Filed: May 2, 2012

(65) Prior Publication Data

US 2013/0083115 A1 Apr. 4, 2013

Related U.S. Application Data

(60) Provisional application No. 61/541,212, filed on Sep. 30, 2011.

(51) Int. Cl.
*B41J 29/38* (2006.01)
*B41J 11/00* (2006.01)

(52) U.S. Cl.
CPC ..... *B41J 11/002* (2013.01)
USPC ..... 347/17; 347/34

(58) Field of Classification Search
CPC .. B41J 2/04563; B41J 2/0458; B41J 2/04528; B41J 2/04541; B41J 2/04553
USPC ..... 347/17, 34, 20, 25, 26, 73–82
See application file for complete search history.

(56) References Cited

U.S. PATENT DOCUMENTS

| | | | | |
|---|---|---|---|---|
| 6,517,197 | B2 | 2/2003 | Hawkins et al. | |
| 2012/0081455 | A1 * | 4/2012 | Kritchman et al. | 347/20 |
| 2013/0141491 | A1 * | 6/2013 | Krichtman et al. | 347/30 |

* cited by examiner

*Primary Examiner* — Manish S Shah
*Assistant Examiner* — Yaovi Ameh
(74) *Attorney, Agent, or Firm* — Roland R. Schindler; William R. Zimmerli

(57) ABSTRACT

Methods for operating a printing system are provided. In one method, an inkjet printhead that is positioned by a support structure is caused to emit droplets of an ink including vaporizable carrier fluid toward a target area to emit droplets according to image data and a shield is used to separate the support structure from the target area to form a first region between the support structure and the shield and a second region between the shield and the target area with the shield providing an opening between the first region and the second region to allow the inkjet printhead to jet droplets to the target area. The shield is heated to a temperature that is at least equal to a condensation temperature of the vaporized carrier fluid in the second region.

25 Claims, 14 Drawing Sheets

INKJET PRINTING SYSTEM WITH CONDENSATION CONTROL SYSTEM

CROSS REFERENCE TO RELATED APPLICATIONS

This application claims the benefit of U.S. Provisional Patent Application No. 61/541,212, filed Sep. 30, 2011, which is incorporated herein by reference in its entirety.

This application relates to commonly assigned, copending U.S. Pat. No. 8,562,115, filed May 2, 2012, entitled: "CONDENSATION CONTROL IN AN INKJET PRINTING SYSTEM"; U.S. application Ser. No. 13/461,832, filed May 2, 2012, entitled: "INKJET PRINTER WITH IN-FLIGHT DROPLET DRYING SYSTEM"; U.S. application Ser. No. 13/461,834, filed May 2, 2012, entitled: "IN-FLIGHT INK DROPLET DRYING METHOD"; U.S. application Ser. No. 13/461,836, filed May 2, 2012, entitled: "MULTI-ZONE CONDENSATION CONTROL SYSTEM FOR INKJET PRINTER"; U.S. application Ser. No. 13/461,838, filed May 2, 2012, entitled: "MULTI-ZONE CONDENSATION CONTROL METHOD"; U.S. application Ser. No. 13/461,845, filed May 2, 2012, entitled: "INKJET PRINTER WITH CONDENSATION CONTROL AIRFLOW SYSTEM"; U.S. application Ser. No. 13/461,850, filed May 2, 2012, entitled: "INKJET PRINTER WITH CONDENSATION CONTROL AIRFLOW METHOD", and U.S. application Ser. No. 13/217,715, filed Aug. 25, 2011, each of which is hereby incorporated by reference.

FIELD OF INVENTION

The present invention relates to controlling condensation of vaporized liquid components of inkjet inks during inkjet ink printing.

BACKGROUND OF THE INVENTION

In an ink jet printer, a print is made by ejecting or jetting a series of small droplets of ink onto a paper to form picture elements (pixels) in an image-wise pattern. The density of a pixel is determined by the amount of ink jetted onto an area. Control of pixel density is generally achieved by controlling the number of droplets of ink jetted into an area of the print. To produce a print containing a single color, for example a black and white print, it is only necessary to jet a single black ink so that more droplets are directed at areas of higher density than areas with lower density.

Color prints are generally made by jetting, in register, inks corresponding to the subtractive primary colors cyan, magenta, yellow, and black. In addition, specialty inks can also be jetted to enhance the characteristics of a print. For example, custom colors to expand the color gamut, low density inks to expand the gray scale, and protective inks such as those containing UV absorbers can also be jetted to onto a paper to form a print.

Ink jet inks are generally jetted onto the paper using a jetting head. Such heads can jet continuously using a continuously jetting print head, with ink jetted towards unmarked or low density areas deflected into a gutter and recycled back into the ink reservoir. Alternatively, ink can be jetted only where it is to be deposited onto the paper using a so-called drop on demand print head. Commonly used heads eject or jet droplets of ink using either heat (a thermal print head) or a piezoelectric pulse (a piezoelectric print head) to generate the pressure on the ink in a nozzle of the print head to cause the ink to fracture into a droplet and eject from the nozzle.

Ink jet printers can broadly be classified as serving one of two markets. The first is the consumer market, where printers are slow; typically printing a few pages per minute and the volumes produced are low. The second market consists of commercial printers, where speeds are typically at least hundreds of pages per minute for cut sheet printers and hundreds of feet per minute for web printers. For use in the commercial market, ink jet prints must be dried as the speed of the printers precludes the ability to allow the prints to dry without specific drying subsystems.

FIG. 1 is a system diagram of one example of a prior art commercial printing system 2, in the example of FIG. 1, commercial printing system 2 has a supply 4 of a paper 6 and a transport system 8 for moving paper 6 past a plurality of printheads 10A, 10B, and 10C. Printheads 10A, 10B and 10C eject ink droplets onto paper 6 as paper 6 is moved past printheads 10A, 10B and 10C by transport system 8. Transport system 8 then moves paper 6 to an output area 14. In this example, paper 6 is shown as a continuous web that is drawn from a spool type supply 4, past printheads 10A, 10B and 10C to an output area 14 where the printed web is wound on to a spool 18. In the embodiment illustrated here, transport system 8 comprises a motor that rotates spool 18 to pull paper 6 past printheads 10A, 10B and 10C.

Inkjet inks generally comprise up to about 97% water or another jettable carrier fluid such as an alcohol that carries colorants such as dyes or pigments suspended or dissolved therein to the paper. Ink jet inks also conventionally include other materials such as humectants, biocides, surfactants, and dispersants. Protective materials such as UV absorbers and abrasion resistant materials may also be present in the inkjet inks. Any of these may be in a liquid form or may be delivered by means of a liquid carrier or solvent. Conventionally, these liquids are selected to quickly vaporize after printing so that a pattern of dry colorants and other materials forms on the receiver soon after jetting.

Commercial inkjet printers typically print at rates of more than fifty feet of printing per minute. This requires printheads 10A, 10B and 10C to eject millions of droplets 12A, 12B and 12C of inkjet ink per minute. Accordingly, substantial volumes of liquids are ejected and begin evaporating at each of printheads 10A, 10B and 10C during operation of such printers.

When an ink jet image is printed on an absorbent paper, the inkjet ink droplets penetrate and are rapidly absorbed by the paper. As the ink is absorbed into the paper, the carrier fluid in the ink droplets spread colorants. A certain extent of spreading is anticipated and this spreading achieves the beneficial effect of increasing the extent of a surface area of the paper colored by the inkjet ink color. However, where spreading exceeds an expected extent, printed images can exhibit any or all of a loss of resolution, a decrease in color saturation, a decrease in density or image artifacts created by unintended combinations of colorants.

Absorption of the carrier fluid from inkjet inks can also have the effect of modifying the dimensional stability of an absorbent paper. In this regard it will be appreciated that the process of paper fabrication creates stresses in the paper that are balanced to create a flat paper stock. However, wetting of the paper partially or completely releases such stresses. In response, the paper cockles and distorts creating significant difficulties during subsequent paper handling, printing, or finishing applications. Cockle and distortion can reduce color to color registration, color saturation, and print density. In addition, cockle and distortion of a print can impede the ability of a printing system to print front and back sides of a paper in register, often referred to as justification.

Further, in some situations, the jetting of large amounts of inkjet ink onto an absorbent paper can reduce the web strength of the paper. This can be particularly problematic in printers such as inkjet printing system 2 that is illustrated in FIG. 1, where, paper 6 is advanced by pulling the paper as the pulling applies additional external stresses to the paper that can further distort the paper.

Semi-absorbent papers absorb the ink more slowly than do absorbent papers. Inkjet printing on semi-absorbent papers can cause liquids from the inkjet ink to remain in liquid form on a surface of the paper for a period of time. Such ink is subject to smearing and offsetting if another surface contacts the printed surface before the carrier fluid in the ink evaporates. Air flow caused by either a drying process or by the transport of the receiver can also distort the wet print. Finally, external contaminants such as dust or dirt can adhere to the wet ink, resulting in image degradation.

To avoid these effects, high speed inkjet printed papers are frequently actively dried using one or more dryers such as dryers 16A, 16B and 16C shown in FIG. 1. Dryers 16A, 16B and 16C typically heat the printed paper and ink, to increase the evaporation rate of carrier fluid from paper 6 in order to reduce drying times. As is shown in FIG. 1, dryers 16A, 16B and 16C are typically positioned as close to the jetting assembly as possible so that the ink is dried in as short a time as possible after being jetted onto the paper. Indeed, it would be desirable to position the dryer subsystem in the vicinity of the jetting module.

However, the increased the rate at which carrier fluid evaporates and creates a localized concentrations of vaporized carrier fluid 17 around printing heads 10A, 10B and 10C. Further, movement of paper 6 through printer 2 drags air and carrier fluid along with paper 6 forming an envelope of air with carrier fluid vapor therein that travels along with printed paper 6 as printed paper 6 moves from print head 10A, to printhead 10B and on to printhead 10C. Accordingly, when a printed portion of paper 6 reaches second printing area 10B a second inkjet image is printed and dried, the concentration of carrier fluid vapor in the air between second printhead 10B and paper 6 is further increased. A similar result occurs at printhead 10C.

These concentrations increase the probability that vaporized carrier fluids 17 will condense on structures within the printer that are at temperature that is below a condensation point of the evaporated carrier fluid. Such condensation can create electrical shorts, cause corrosion and can interfere with ink jet droplet formation. Further, there is the risk that such condensates will form droplets 19 on structures such as printhead 10B or printhead 10C from which they can fall, transfer or otherwise come into contact with a printed paper so as to create image artifacts on the paper. This risk is particularly acute for structures that are in close proximity to a paper path through the printer.

One example of such a structure is a mounting frame such as a mounting plate to which one or more ink jetting module is fixed. The jetting module and mounting plate are located in close proximity to, and generally directly above, the paper onto which the ink is jetted. Once condensed, the carrier fluids form droplets 19 that can contact or drip onto the printed paper. This causes the inked image to run, thereby creating image degradations and distortions.

It is clear that methods and apparatuses for reducing or eliminating condensation in an inkjet printer are needed.

SUMMARY OF THE INVENTION

Methods for operating a printing system are provided. In one method, an inkjet printhead that is positioned by a support structure is caused to emit droplets of an ink including vaporizable carrier fluid toward a target area to emit droplets according to image data and a shield is used to separate the support structure from the target area to form a first region between the support structure and the shield and a second region between the shield and the target area with the shield providing an opening between the first region and the second region to allow the inkjet printhead to jet droplets to the target area. The shield is heated to a temperature that is at least equal to a condensation temperature of the vaporized carrier fluid in the second region.

DETAILED DESCRIPTION OF THE INVENTION

Figure 2:
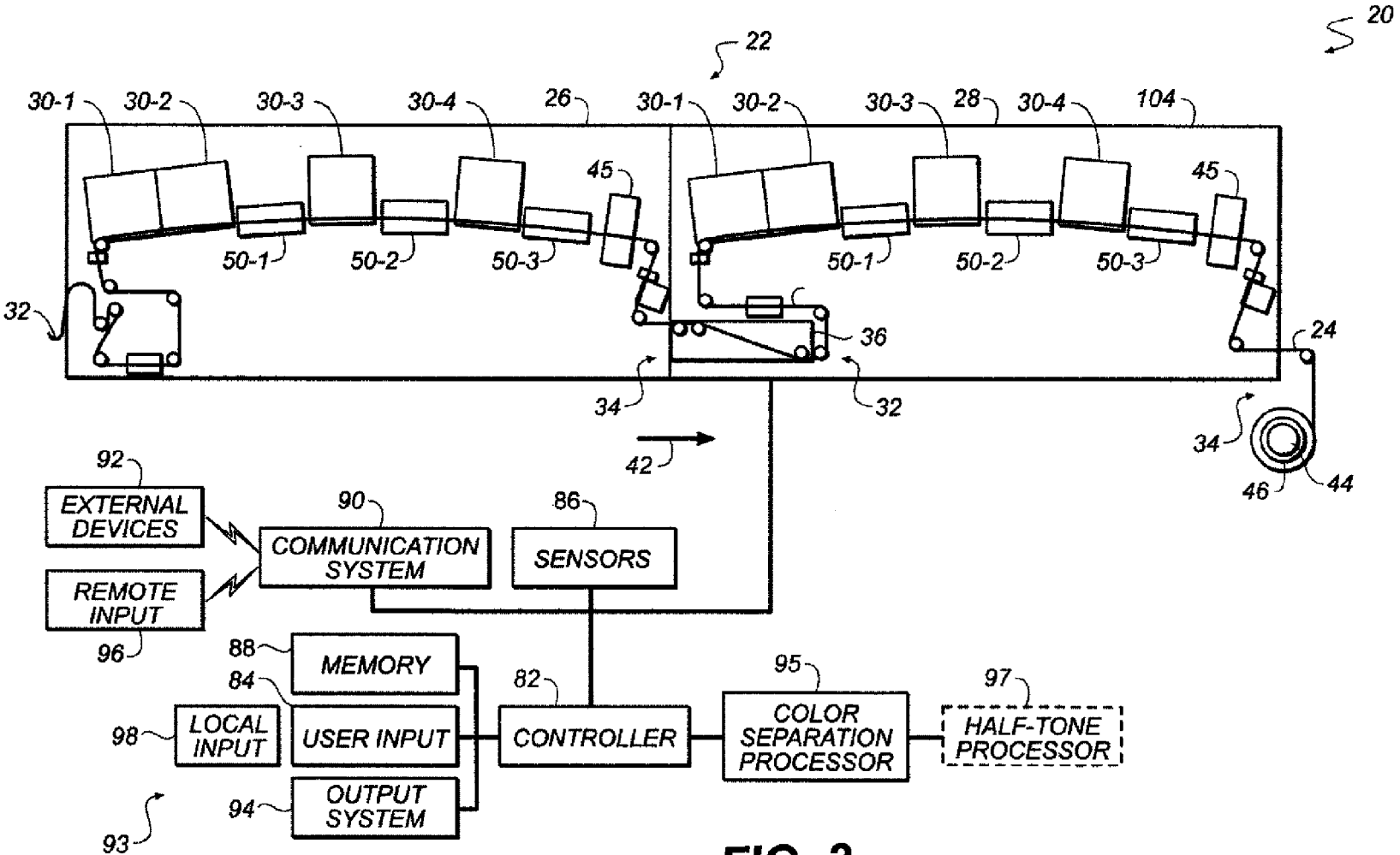
FIG. 2 illustrates a side schematic view of one embodiment of an inkjet printing system.

FIG. 2 is a side schematic view of a first embodiment of an inkjet printing system 20. Inkjet printing system 20 has an inkjet print engine 22 that delivers one or more inkjet images in registration onto a receiver 24 to form a composite inkjet image. Such a composite inkjet image can be used for any of a plurality of purposes, the most common of which is to provide a printed image with more than one color. For example, in a four color image, four inkjet images are formed, with each inkjet image having one of the four subtractive primary colors, cyan, magenta, yellow, and black. The four color inkjet inks can be combined to form a representative spectrum of colors. Similarly, in a five color image various combinations of any of five differently colored inkjet inks can be combined to form a color print on receiver 24. That is, any of five colors of inkjet ink can be combined with inkjet ink of one or more of the other colors at a particular location on receiver 24 to form a color after a fusing or fixing process that is different than the colors of the inkjets inks applied at that location.

In the embodiment of FIG. 2, inkjet print engine 22 is optionally configured with a first print engine module 26 and a second print engine module 28. In this embodiment, first side print engine and second print engine module 28 have corresponding sequences of printing modules 30-1, 30-2, 30-3, 30-4, also known as lineheads that are positioned along a direction of travel 42 of receiver 24. Printing modules 30-1, 30-2, 30-3, 30-4 each have an arrangement of printheads (not shown in FIG. 2) to deliver inkjet droplets to form picture elements that create a single inkjet image 25 on a receiver 24 as receiver 24 is advanced from an input area 32 to an output area 34 by a receiver transport system 40 along the direction of travel 42.

Receiver transport system 40 generally comprises structures, systems, actuators, sensors, or other devices used to advance a receiver 24 from an input area 32 past print engine 22 to an output area 34. In FIG. 2, receiver transport system 40 comprises a plurality of rollers R, and optionally other forms of contact surfaces that are known in the art for guiding and directing a continuous type receiver 24. As is also shown in the embodiment of FIG. 2, first print engine module 26 has an output area 34 that is connected to an input area 32 of second print engine module 28 by way of an inverter module 36. In operation, receiver 24 is first moved past first print engine module 26 which forms one or more inkjet images on a first side of receiver 24, and is then inverted by inverter module 36 so that second print engine module 28 forms one or more inkjet images in registration with each other on a second side of receiver 24. A motor 44 is positioned proximate to output area 34 of second print engine module 28 that rotates a spool 46 to draw receiver 24 through first print engine module 26 and second print engine module 28.

Figure 3:
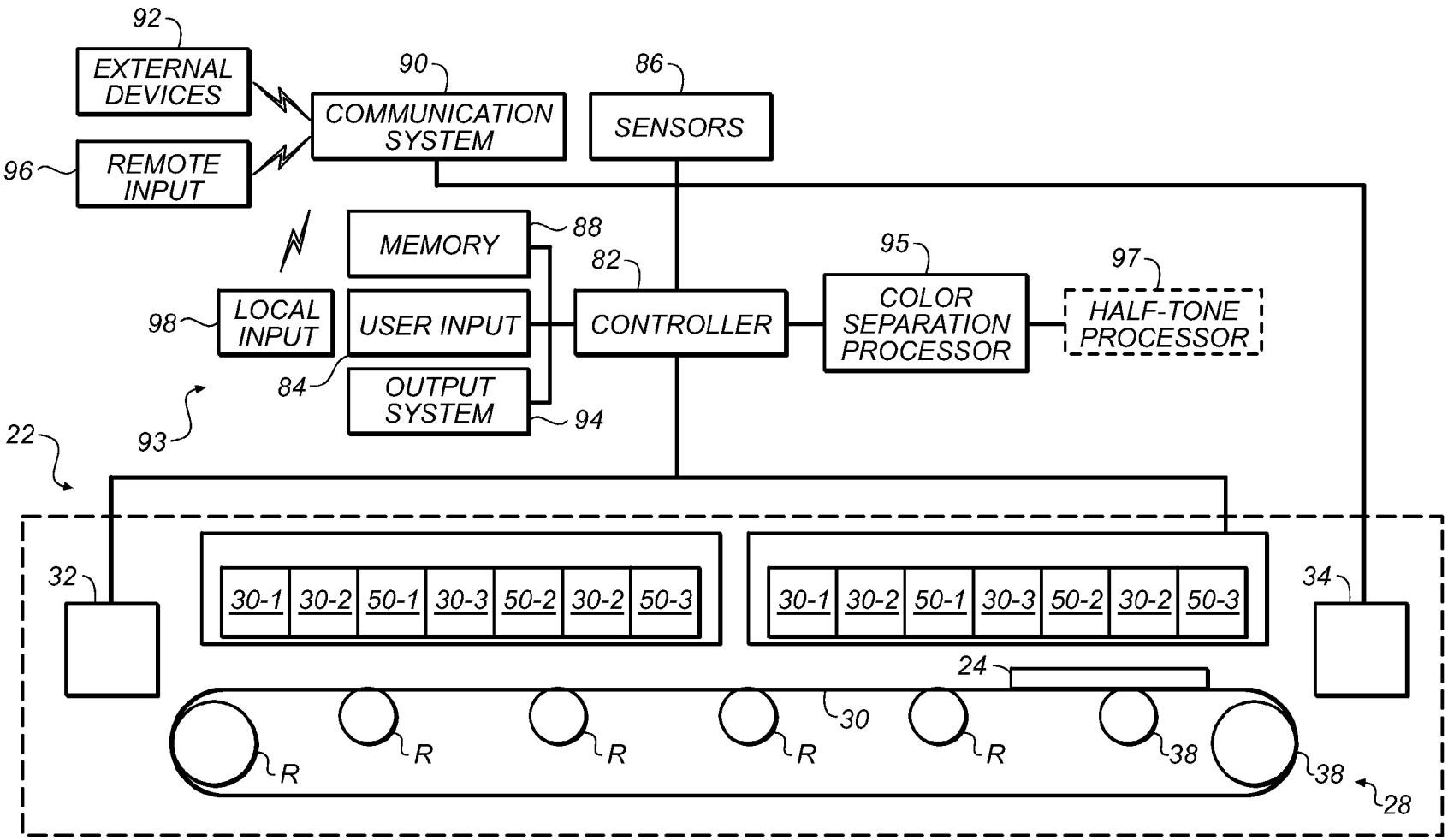
FIG. 3 illustrates a side schematic view of another embodiment of an inkjet printing system.

In an alternate embodiment illustrated in FIG. 3, a print engine 22 is optionally illustrated with only a first print engine module 26 and with a receiver transport system 40 that includes a movable surface such as an endless belt 38 that is that is supported by rollers R which in turn is operated by a motor 44. Such an embodiment of a receiver transport system 40 is particularly useful when receiver 24 is supplied in the form of pages as opposed to a continuous web. However, in other embodiments receiver transport system 40 can take other forms and can be provided in segments that operate in different ways or that use different structures. Other conventional embodiments of a receiver transport system can be used.

Printer 20 is operated by a printer controller 82 that controls the operation of print engine 22 including but not limited to each of the respective printing modules 30-1, 30-2, 30-3, 30-4 of first print engine module 26 and second print engine module 28, receiver transport system 40, input area 32, to form inkjet images in registration on a receiver 24 or an intermediate in order to yield a composite inkjet image 27 on receiver 24.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment surrounding printer 20 and to convert this information into a form that can be used by printer controller 82 in governing printing, drying, other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 2, these sources include memory 88, communication system 90, that printer 20 can receive such image data through local generation or processing that can be executed at printer 20 using, for example, user input system 84, output system 94 and printer controller 82. Print order information can also be generated by way of remote input 56 and local input 66 and can be calculated by printer controller 82. For convenience, these sources are referred to collectively herein as source of print order information 93. It will be appreciated, that this is not limiting and that source of print order information 93 can comprise any electronic, magnetic, optical or other system known in the art of printing that can be incorporated into printer 20 or that can cooperate with printer 20 to make print order information or parts thereof available.

In the embodiment of printer 20 that is illustrated in FIGS. 2 and 3, printer controller 82 has an optional color separation image processor 95 to convert the image data into color separation images that can be used by printing modules 30-1, 30-2, 30-3, 30-4 of print engine 22 to generate inkjet images. An optional half-tone processor 97 is also shown that can process the color separation images according to any half-tone screening requirements of print engine 22.

Figure 1:
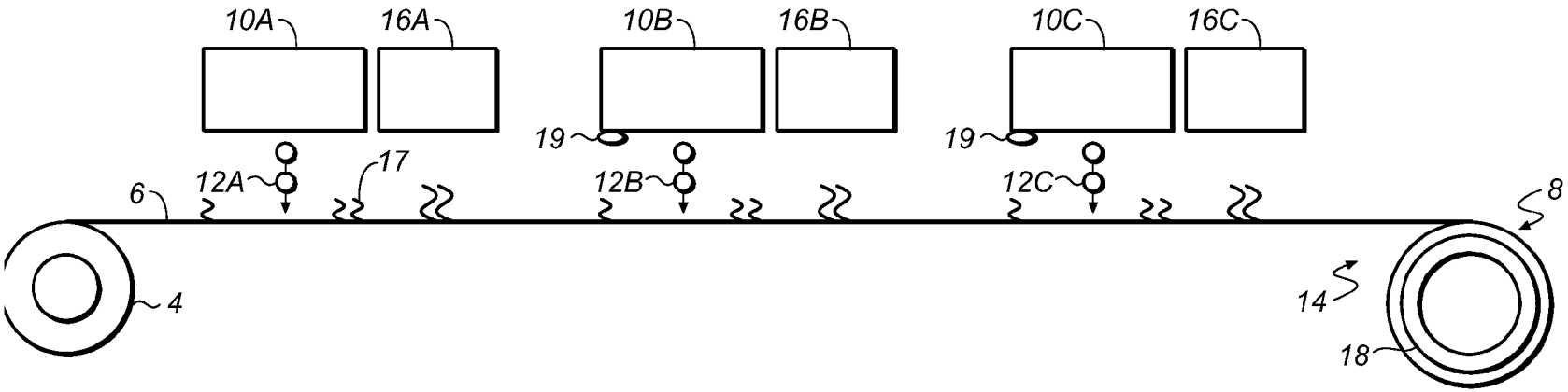
FIG. 1 (PRIOR ART)
FIG. 1 illustrates a side schematic view of a prior art inkjet printing system.
Figure 4:
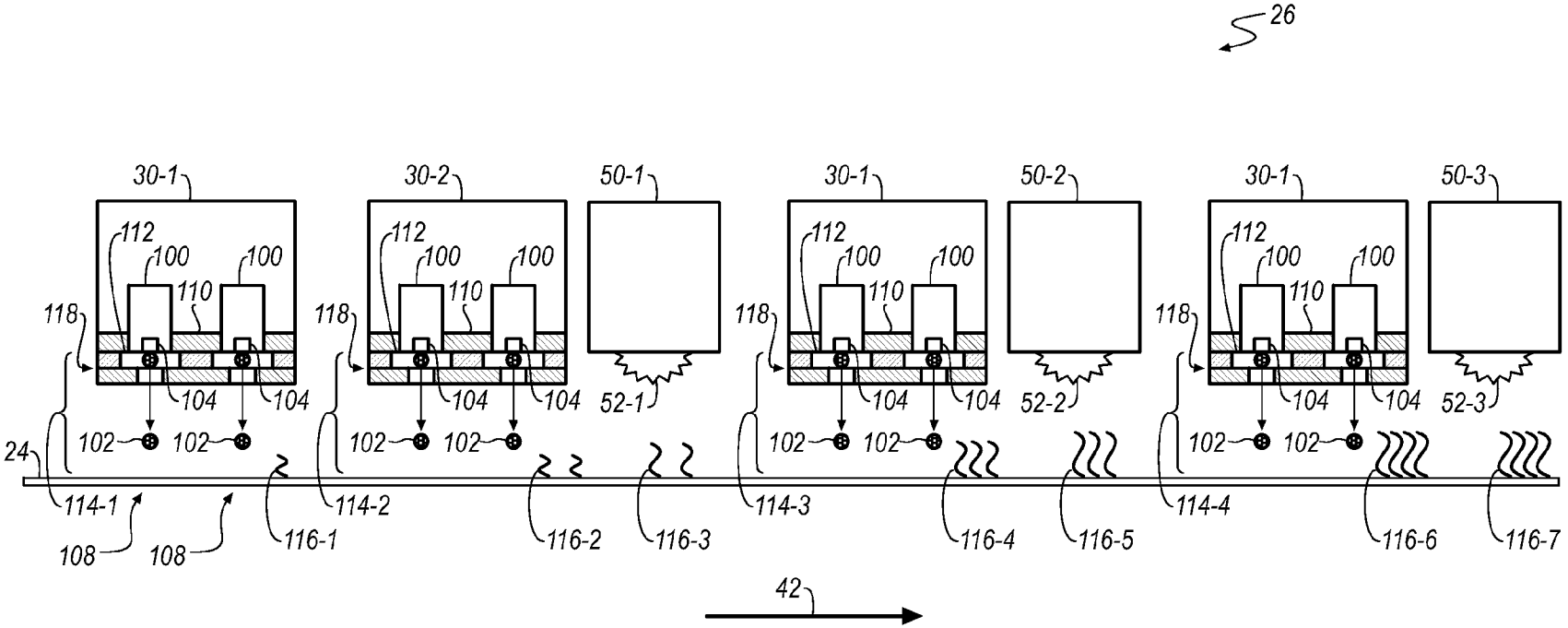
FIG. 4 provides, a schematic view of the embodiment of first print engine module of FIGS. 1-2 in greater detail.

FIG. 4 provides, a schematic view of the embodiment of first print engine module 26 of FIGS. 1-3 in greater detail. As is shown in FIG. 4, receiver 24 is moved past a series of inkjet printing modules 30-1, 30-2, 30-3, 30-4 which typically include a plurality of inkjet printheads 100 that are positioned by a support structure 110 such that a face 106 of each of the inkjet printheads 100 is positioned so nozzles 104 jet ink droplets 102 toward a target area 108. As used herein target area 108 includes any region into which ink jet droplets ejected by an inkjet printhead 100 supported by a support structure are expected to land on a receiver to form picture elements of an inkjet printed image.

Inkjet printheads 100 can use any known form of inkjet technology to jet ink droplets 102. These can include but are not limited to drop on demand inkjet jetting technology (DOD) or continuous inkjet jetting technology (CIJ). In "drop-on-demand" (DOD) jetting, a pressurization actuator, for example, a thermal, piezoelectric, or electrostatic actuator causes ink drops to jet from a nozzle only when required. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

In "continuous" ink jet (CIJ) jetting, a pressurized ink source is used to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection. The inventions described herein are applicable to both types of printing technologies and to any other technologies that enable jetting of drops of an ink consistent with what is claimed herein. As such, inkjet printheads 100 are not limited to any particular jetting technology.

In the embodiment of FIGS. 2-5 Inkjet printheads 100 of inkjet printing module 30-1 are located and aligned by a support structure 110. In this embodiment, support structure 110 is illustrated as being in the form of a plate having mountings 112 that are in the form of openings into which individual inkjet printheads 100 are mounted.

In the embodiments that are shown in FIGS. 2-4 dryers 50-1, 50-2, 50-3, are provided to apply heat to help dry receiver 24 by accelerating evaporation of carrier fluid in the inkjet ink. Dryers 50-1, 50-2, and 50-3 can take any of a variety of forms including, but not limited to dryers that use radiated energy such as radio frequency emissions, visible light, infrared light, microwave emissions, or other such radiated energy from conventional sources to heat the carrier fluid directly or to heat the receiver so that the receiver heats the carrier fluid. Dryers 50-1, 50-2, and 50-3 can also apply heated air to a printed receiver 24 to heat the carrier fluid. In other embodiments, dryers 50-1, 50-2, and 50-3 can use heated surfaces such as heated rollers that support and heat receiver 24.

As ink droplets 102 are formed, travel to receiver 24, and dry vaporized carrier fluid is introduced into the surrounding environment. This raises the concentration of vaporized carrier fluid 116 in a gap 114 between support structure 110 and target area 108. This effect is particularly acute in gaps 114 between the printer components (for example, printing modules 30 and dryers 50) and a target area 108 within which receiver 24 is positioned. To simplify the description to the extent that terms such as moisture, humid, and humidity, may be used in this specification that in a proper sense relate only to water in either a liquid or gaseous form. These terms refer to the corresponding liquid or gaseous phases of the solvents, carrier fluids, or any other jetted materials that make up a liquid portion of inkjet inks ejected as ink droplets 102 by inkjet printheads 100. When the ink is based on a solvent other than water, these terms are intended to refer to the liquid and gaseous forms of such solvents in a corresponding manner. In various embodiments herein ink droplets are generally referred to as delivering colorants to receiver 24 however, it will be appreciated that in alternate embodiments ink droplets can deliver other functional materials thereto including coating materials, protectants, conductive materials and the like.

During printing inkjet printing modules such as inkjet printing module 30-1 rapidly form and jet ink droplets 102 onto receiver 24. This process adds vaporized carrier fluid to the air in gap 114-1 creating a first concentration of vaporized carrier fluid 116-1 and also increasing a risk of condensation on downstream portions of the support structure 110.

Further, as receiver 24 moves in the direction of travel 42 (left to right as shown in FIG. 4), warm humid air adjacent to receiver 24 is dragged along or entrained by the moving receiver 24. As a result, a convective current develops and causes the warm humid air to flow along direction of travel 42. When this happens, a substantial portion of the concentration of vaporized carrier fluid 116-1 in the air in a first gap 114-1 between nozzles 104 and target area 108 at inkjet printing module 30-1 travels with receiver 24 and enters a second gap 114-2 between nozzles 104 and target area 108 at inkjet printing module 30-2 where additional ink droplets 102 are emitted and add to the concentration of vaporized carrier fluid 116-1 to create a second carrier fluid concentration 116-2 that is greater than the first carrier fluid concentration 116-1.

Receiver 24 then passes beneath dryer 50-1 which applies energy 52-1 to heat receiver 24 and any ink thereon. The applied energy 52-1 accelerates the evaporation of the water or other carrier fluids in the ink. Although such dryers 50-1, 50-2, and 50-3 often include an exhaust system for removing the resulting warm humid air from above receiver 24, some warm air with vaporized carrier fluid can still be dragged along by moving receiver 24 as it leaves dryer 50-1. As a result, a third concentration of carrier fluid entering in third gap 114-3 between nozzles 104 and target area 108 at inkjet printing module 30-3 is greater than the second concentration of vaporized carrier fluid 116-2. Printing of ink droplets 102 at inkjet printing module 30-3 creates a fourth concentration of vaporized carrier fluid 116-4 exiting gap 114-3. To the extent that receiver 24 remains at an increased temperature after leaving dryer 50-1 carrier fluid from the ink can be caused to evaporate from receiver 24 at a faster rate further adding moisture into gap 114-3 such that the fourth concentration of vaporized carrier fluid 116-4 is found in gap 114-4 after receiver 24 has been moved past inkjet printing module 30-2 and dryer 50-1.

Accordingly, where multiple inkjet printing modules 30 jet ink onto receiver 24, vaporized carrier fluid concentrations near a receiver 24 can increase in like fashion cascading from a first level 116-1 to second level 116-2, to a third level 116-3 and so on up to a seventh, highest level 116-7 after dryer 50-3. As such, the risk of condensation related problems increases with each additional printing undertaken by inkjet printing modules 30-2, 30-3, and 30-4 downstream of dryer 50-1 it is necessary to reduce the risk that these concentrations will cause condensation that damages the printer.

Figure 5:
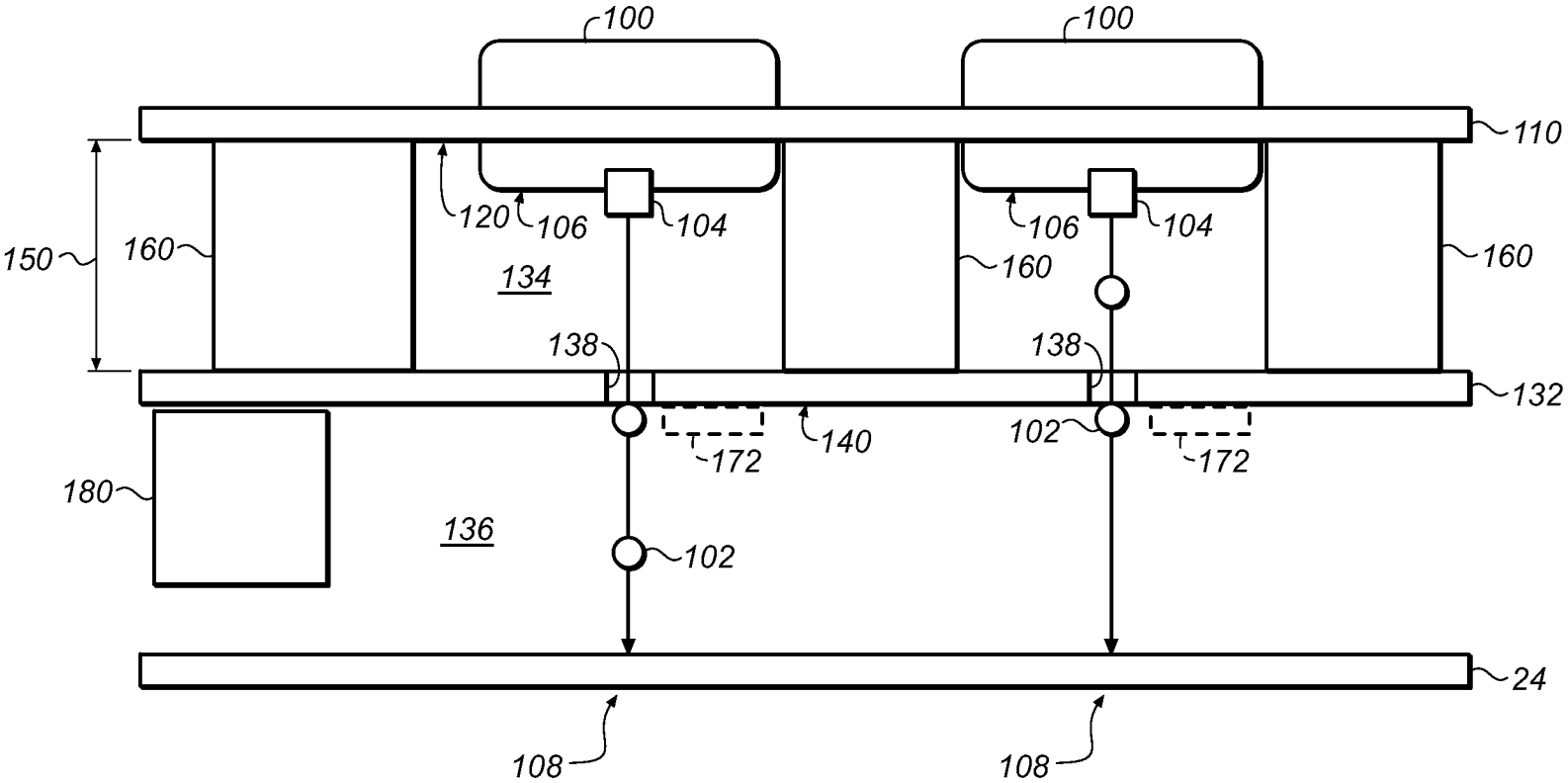
FIG. 5 shows a first embodiment of an apparatus for controlling condensation in an inkjet printing system.

As is shown in outline in FIG. 4 and in detail in FIG. 5, inkjet printing system 20 has a condensation control system 118 that in this embodiment includes a shield 132, thermally insulating separators 160, and an energy source 180 to cause heating of shield 132 at each inkjet printing module 30. Shield 132 is positioned between support structure 110 and target area 108. This creates a first region 134 between support structure 110 and shield 132 and a second region 136 between shield 132 and target area 108.

In the embodiment of FIG. 5, shield 132 is non-porous and serves to prevent condensation from accumulating on support structure 110 and on faces 106 of inkjet printheads 100. Shield 132 also provides some protection from physical damage to support structure 110, for example, protection from physical damage potentially caused by an impact of receiver 24 against a face 120 of support structure 110. Relatively speaking, shield 132 can extend, for example, across a width of inkjet printing module 30-1 to provide surface area that is relatively large compared to a small thickness that is for example, on the order of about 0.1 mm to 1 mm.

As such, shield 132 can have a low thermal capacity so that shield 132 will absorb energy and heat rapidly and generally uniformly when heated or otherwise exposed to an energy from an energy source and otherwise will act to rapidly approach the ambient temperature. In certain embodiments this ambient temperature will be at or above a condensation temperature of the vaporizable carrier fluid in the second region 136. Increasing the temperature of shield 132 reduces or prevents condensation from forming and accumulating on a face 140 of shield 132 that faces target area 108. Where a temperature difference between a warm vapor bearing air and shield 132 approaches zero, condensation is less likely to form on shield 132 and where the temperature of shield 132 exceeds condensation temperature, condensation can be avoided.

In the embodiment of FIGS. 2-5 shield 132 is made of a material having a high thermal conductivity, such as aluminum or copper. The high thermal conductivity of such an embodiment of shield 132 helps to distribute heat more uniformly across shield 132 so that the temperature of shield 132 maintains a generally uniform temperature and avoids the formation of localized regions of lower temperature that may enable the formation of condensation. Optionally shield 132 can be made from a non-corrosive material such as a stainless steel.

Additionally, in this embodiment, shield 132 has higher emissivity (e.g., greater than 0.75) to better absorb thermal energy radiating onto shield 132. For example, shield 132 is preferably anodized black in color. Alternatively, shield 132 can be another dark color. Absorption of the thermal energy radiating onto shield 132 can passively increase the temperature of shield 132.

In other embodiments shield 132 can be made of a material having a lower thermal conductivity, such as for example, other metal materials and ceramic materials. In still other embodiments, shield 132 can be made from any of a stainless steel, a polyamide, polyester, vinyl and polystyrene, and polyethylene terephthalate.

Shield 132 has at least one opening 138 through which nozzles 104 can jet ink droplets 102 to target area 108. In the embodiment of FIGS. 4 and 5 shield 132 is illustrated as having an optional arrangement of two openings 138 through which ink droplets 102 can pass from inkjet printheads 100 to target area 108.

Figure 6:
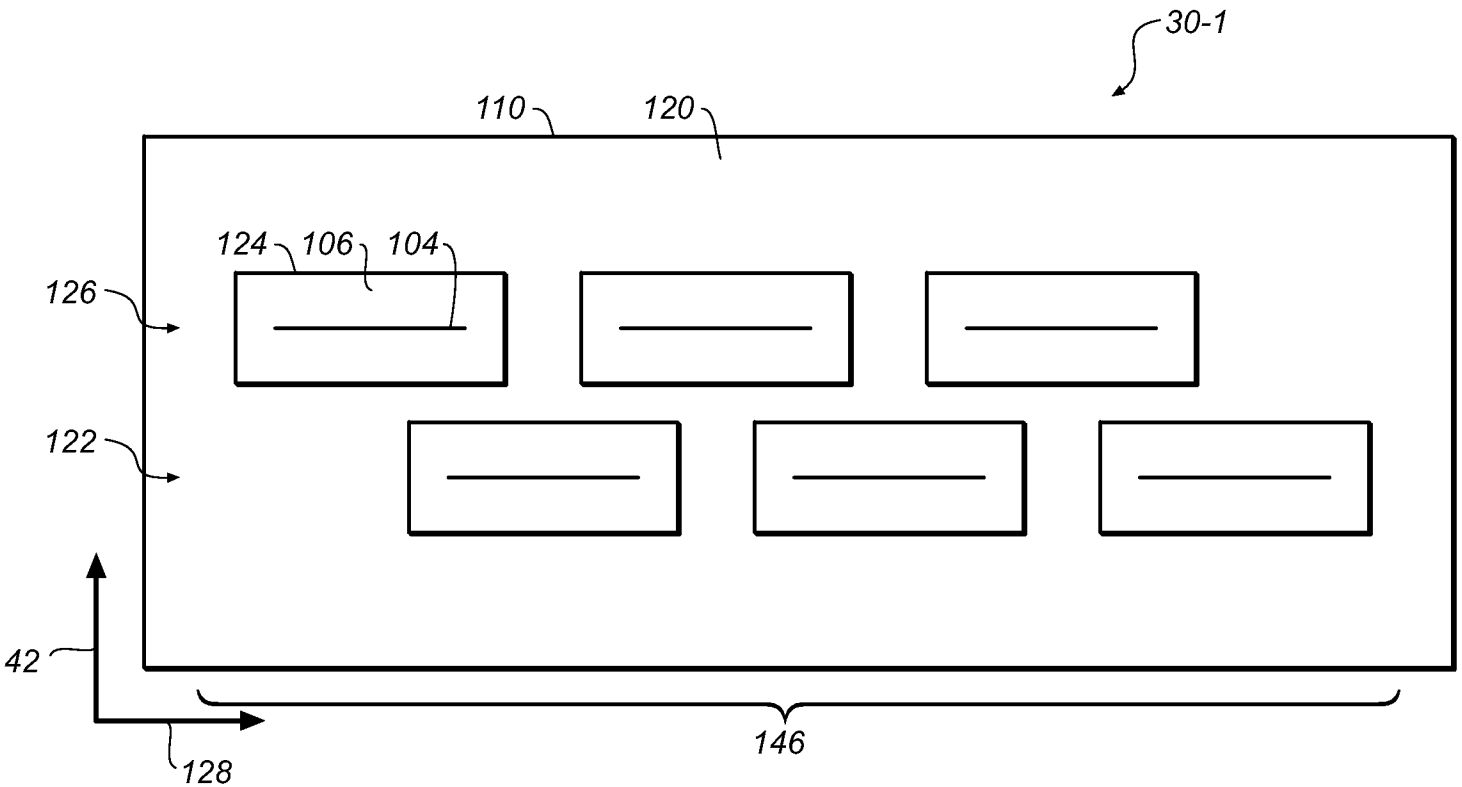
FIGS. 6 and 7 respectively illustrate a face 120 of support structure 110 and a face of a corresponding shield 132 that confront a target area 108.
Figure 7:
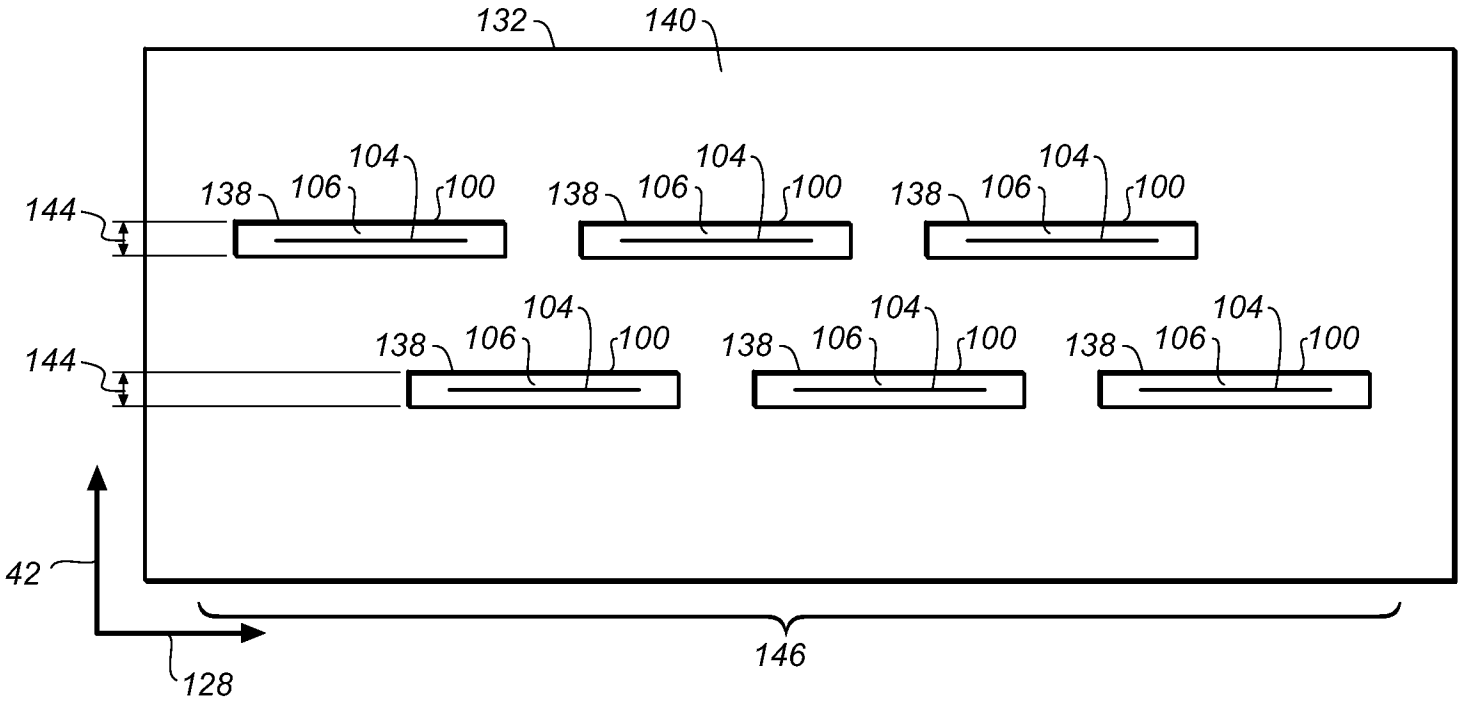

In one embodiment, the one or more openings 138 can be shaped or patterned to correspond to an arrangement of nozzles 104 in an inkjet printing module such as inkjet printing module 30-1. One example of this type is illustrated in FIGS. 6 and 7 which respectively illustrate a face 120 of support structure 110 and a face of a corresponding shield 132 that confront a target area 108. As is shown in this embodiment, support structure 110 has a first row 122 with a plurality of mountings 124 that in this embodiment extend through a thickness of support structure 110 each aligned with a linear array of nozzles 104 on a face 106 of inkjet printhead 100. Mountings 124 are in a spaced arrangement along a width axis 128 that is normal to a direction of travel 42 of receiver 24 past inkjet printing module 30-1. Support structure 110 also has a second row 126 with a plurality of mountings 124 also spaced from each other and distributed laterally across a width axis 128. Each opening has an inkjet printhead 100 therein with a linear array of nozzles 104. As can be seen from FIG. 6, the arrangement of mountings 124 in first row 122 is offset from the arrangement of mountings 124 in second row 126 to position linear arrays of nozzles 104 such that inkjet printing module 30-1 can eject ink droplets (not shown) across a continuous range of positions 146 across width axis 128.

FIG. 7 shows a view of face 140 of shield 132 that is placed over the support structure 110 and printheads 100 illustrated in FIG. 6, also from the perspective of target area 108. As is shown in FIG. 7, shield 132 provides a plurality of openings 138 that provide paths for inkjet drops (not shown) that are ejected from the linear arrays of nozzles 104 to pass through shield 132. As can be seen from FIG. 7, openings 138 partially cover inkjet printheads 100 while still providing openings that have a minimum cross-sectional distance to allow ink droplets to pass there through without interference.

In the embodiment of FIG. 7, openings 138 are sized and shaped to help to limit the extent to which vaporized carrier fluid can reach first region 134 from second region 136 while not interfering with the transit of ink droplets 102 through openings 138. In one embodiment, this is done by providing that openings 138 have a size in a smallest cross sectional distance 144 that is limited to limit the extent to which vaporized carrier fluid concentrations from second region 136 can reach first region 134. In this example, openings 138 shown in FIG. 7 extend for a comparatively long distance in one cross sectional distance along width axis 128. However, openings 138 extend only a short distance along the direction of travel 42 causing the smallest cross sectional distance 144 to be along direction of travel 42. In one embodiment, the smallest cross sectional distance 144 is limited, interposing shield 132 between substantial amount of a surface area of face 120 support structure 110 as well as a substantial portion of a surface area of each of the faces 106 of inkjet printheads 100.

In one embodiment, the smallest cross-sectional distance 144 of an opening is defined as a function of a size of an ink droplet 102 such as 150 times the size of an average weighted diameter of ink droplets 102 ejected by an inkjet printhead 100. For example, in one embodiment, the smallest distance can be on the order of less than 300 times an average diameter of inkjet droplets while in other embodiments, the smallest cross-sectional distance of an opening 138 can be on the order of less than 150 times the average diameter of inkjet droplets 102 and, in still other embodiments, the smallest cross-sectional distance of an opening 138 can be on the order of about 25 to 70 times the average diameter of a diameter of inkjet droplets.

In other embodiments, a smallest cross-sectional distance 144 of the one or more opening 138 can be determined based upon the expected flight envelope of ink droplets 102 as inkjet droplets were to travel from nozzles 104 to target area 108. That is, it will be expected that ink droplets 102 will travel nominally along a flight path from nozzles 104 to target area 108 and that there will be some variation in flight path of any individual inkjet drop relative to the nominal flight path and that the expected range of variation can be predicted or determined experimentally and can be used to define the smallest cross-sectional area of the smallest cross-sectional distance 144 of one or more opening 138 such that an opening 138 has a smallest cross-sectional distance that does not interfere with the flight of any inkjet droplet from a nozzle 104 to a target area 108.

It will be appreciated that other embodiments are possible. For example, in other embodiments a separate opening 138 can be provided for each printhead 100 while in still other embodiments a single opening 138 can be patterned to provide one opening through which all ink droplets 102 can be jetted.

Returning now to FIG. 5, shield 132 is positioned at a separation distance 150 from support structure 110 using a thermally insulating separator 160. In the embodiment that is shown in FIG. 5, thermally insulating separator 160 is in contact with face 120 of support structure 110 and is used to hold shield 132 in fixed relation with support structure 110. Thermally insulating separator 160 can join support structure 110 to shield 132 in any of a variety of ways, including but not limited to the use of conventional mechanical fasteners, adhesives, and magnetic attraction. A thermally insulating separator 160 can be permanently fixed to either or both of support structure 110 and shield 132. Conversely a thermally insulating separator 160 can be removably mounted to either or both of support structure 110 and shield 132.

For example, in one embodiment, thermally insulating separator 160 can take the form of a thin layer of a magnetic material that is joined to selected regions of shield 132. In other embodiments, shield 132 is positioned between the support structure 110 and target area 108 by a plurality of thermally insulating separators 160. Such a plurality of thermally insulating separators 160 can take the form of pins, bolts, or other forms of connectors.

Thermally insulating separator 160 can be made to be thermally insulating through the use of thermally insulating materials including but not limited to air, or other gasses, Bakelite, silicone, ceramics or aerogel based materials. Thermally insulating separator 160 can also be made to be thermally insulating by virtue a shape or configuration, such as by forming thermally insulating separator 160 through the use of a tubular construction. In one embodiment of this type, a poor thermal insulator such as stainless steel can be made to act as a thermal insulator by virtue of assembling the stainless steel in a tubular fashion. Optionally, both approaches can be used.

Thermally insulating separator 160 can have a fixed size or can vary with temperature. In one embodiment, a thermally insulating separator 160 is thermally expansive so that thermal insulator expands the separation between shield 132 and support structure 110 when the temperature of a shield 132 increases.

It will be appreciated that the separation distance 150 creates a first region 134 that provides an air gap between support structure 110 and any inkjet printheads 100 mounted thereto and shield 132. In this way, shield 132 is thermally insulated from inkjet printheads 100 and support structure 110 such that shield 132 can have a temperature that is greater than a temperature of support structure 110 without heating inkjet printheads 100 and support structure 110 to an unacceptable level.

This in turn allows shield 132 to be actively heated to a temperature that is above a condensation point for the vaporized carrier fluids in second region 136 while allowing inkjet printheads 100 and support structure 110 to remain at cooler temperatures, including, in some embodiments, temperatures that are below a condensation temperature of the vaporized carrier fluids in second region 136.

Accordingly in the embodiment that is illustrated in FIG. 5, an energy source 180 is provided. Energy source 180 supplies an energy that causes shield 132 to heat to a temperature that is above a condensation temperature of any vaporized carrier fluid in second region 136. There are a number of ways in which this can be done. In one embodiment, energy source 180 generates energy that shield 132 or an optional energy converting material 172 on shield converts into heat. For example, energy source 180 can comprise a radiation source such as a light emitter or an antenna and appropriate signal generation circuitry that causes the antenna to radiate energy in the form of, for example, visible or invisible light, microwave signals or other radio frequency signals that are absorbed by shield 132 or optionally by energy converting material 172 on shield 132 to cause shield 132 to heat.

In still other embodiments, energy source 180 can supply electrical energy to an energy converting material 172 in the form of resistors or other devices that convert electrical energy into heat. Alternatively, energy source 180 can supply electrical energy to a thermoelectric heat pump or "Peltier Cooler" that pumps heat from one side of the cooler to another side of the cooler. Such a thermoelectric heat pump can be arranged to pump heat from a side 142 of shield 132 confronting first region 136 to a side in contact with shield 132. In a further embodiment, the energy source can comprise a heater that heats a heated contact surface that is in contact with the shield to transfer heat to the shield.

In yet another embodiment, energy source 180 can apply energy to cause an intermediate material to heat which, in turn, heats face 140 of shield 132 to a temperature that is above the condensation temperature of the vaporized carrier fluid. In one embodiment of this type, the intermediate material is receiver 24. In such an embodiment, energy source 180 comprises a source of energy that heats receiver 24 before receiver 24 enters a target area 108 such that heat from receiver 24 heats shield 132 to a temperature that is above the condensation temperature of the vaporized carrier fluid. Receiver 24 then heats shield 132 by way of infrared radiation or by heating the air between the receiver 24 and the heat shield 132 such that the heated air heats shield 132 as receiver 24 is moved through the second region. Conventional heaters such as heated rollers and commercial paper dryers that heat paper using heated air or using microwave, infrared lamps and the like can be used to heat receiver 24. Dryers such as dryers 50-1 and 50-2 shown in the embodiments of FIGS. 3 and 4 can be used to heat receiver 24 for purposes that include both drying of ink and heating a downstream shield 132.

The heating of shield 132 can be uniform or patterned. In one embodiment of this type, energy converting material 172 is patterned to absorb applied energy so that different portions of shield 132 heat more than other portions when the energy source generates the energy. In another embodiment, a non-uniform heating of shield 132 can be achieved by causing energy source 180 to radiate energy that is partially masked so that different portions of shield 132 can receive different amounts of the radiated energy, causing the shield 132 to heat differently in masked portions than in unmasked portions. Such masking can be performed for example by concentrating light away from particular areas of shield 132 and other portions of the shield 132 or by positioning energy absorbing or reflecting materials between energy source 180 and shield 132.

Such non-uniform heating of shield 132 can be used for a variety of purposes. In one embodiment, energy source 180 emits an energy that causes shield 132 to heat to a higher temperature away from the one or more openings 158 than proximate to the one or more openings.

It will be appreciated from the forgoing that portions of shield 132 are located between portions of the face of the printheads and the target area to limit the extent to which vaporized carrier fluid passes from second region 136 to first region 134. In certain embodiments, this also advantageously limits the extent to which any radiated energy can directly impinge upon the faces 106 of the printheads 100.

Figure 8:
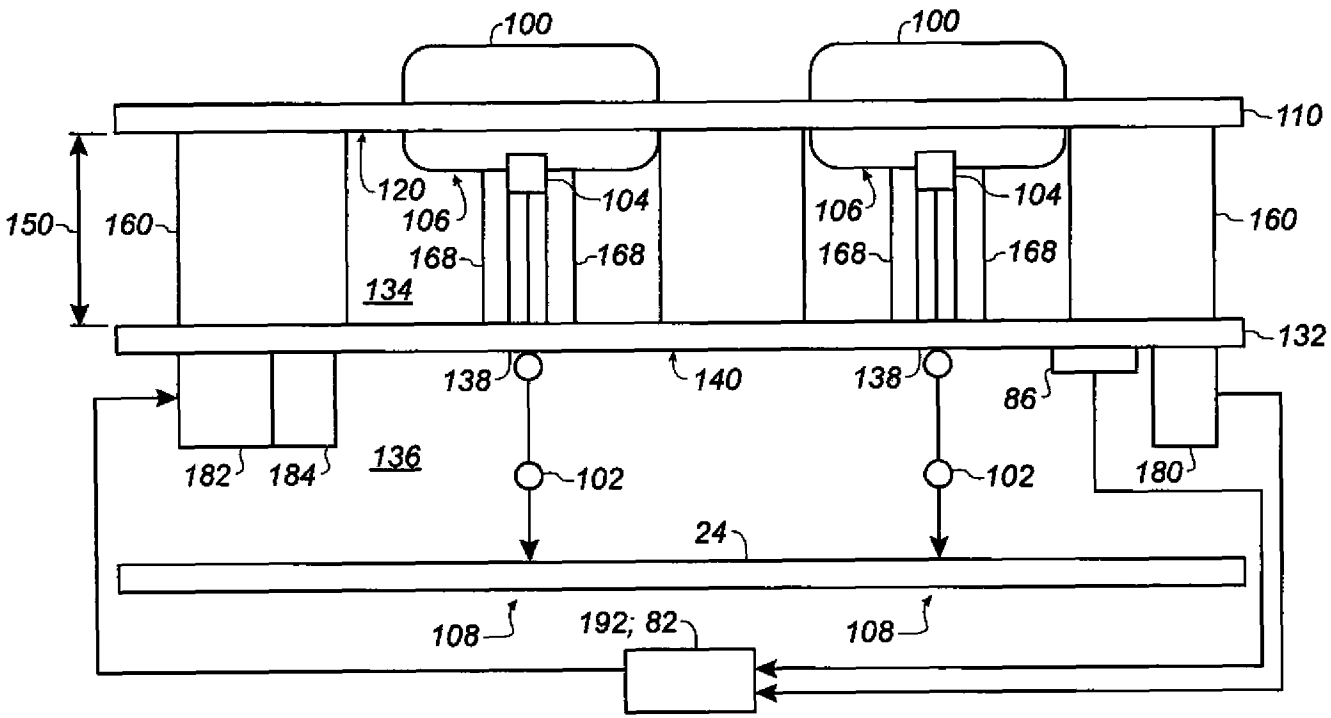
FIG. 8 shows another embodiment of a condensation control system of an inkjet printing system.

In some embodiments the heating of shield 132 is controlled through a feedback system using sensors 86 to sense conditions in second region 136 and a controller such as printer controller 82 generate signals that control an amount of energy supplied by energy source 180 so as to dynamically control the heating of shield 132. FIG. 8 illustrates one embodiment of this type having a sensor 86 positioned in second region 136 and operable to generate a signal that is indicative of as a ratio of the partial pressure of carrier fluid vapor in an air-carrier fluid mixture in second region 136 to the saturated vapor pressure of a flat sheet of pure carrier fluid at the pressure and temperature of second region 136. The signal from sensor 86 is transmitted to control circuit such as printer controller 82 or a local controller such as an optional printing module control circuit 192 that controls an amount of energy supplied by the energy source to heat the shield according to the relative humidity in the second region 136.

In another embodiment, sensor 86 can comprise a liquid condensation sensor located proximate to shield 132 operable to detect condensation on face 140 of shield 132 facing the second region 136 and further operable to generate a signal that is indicative of the liquid condensation, if any. The signal from sensor 86 is transmitted to control circuit such as printer controller 82 so that printer controller 82 can controls an amount of energy supplied by energy source 180 to cause shield 132 to heat according to the sensed condensation at face 140.

In still another embodiment, sensor 86 can comprise temperature sensor located proximate to shield 132 operable to detect a temperature of shield 132 facing the second region 136 and further operable to generate a signal that is indicative of the temperature of shield 132. The signal from sensor 86 is transmitted to control circuit such as printer controller 82 so that printer controller 82 controls an amount of energy supplied by energy source 180 to cause shield 132 to heat according to the sensed temperature at face 140.

In yet another embodiment, sensor 86 can comprise receiver temperature sensor that is operable to detect conditions that are indicative of a temperature of receiver 24 such as an intensity of infra-red light emitted by receiver 24 and further operable to generate a signal that is indicative of temperature of receiver 24. The signal from sensor 86 is transmitted to control circuit such as printer controller 82 so that printer controller 82 can control an amount of energy supplied by energy source 180 to cause shield 132 to heat according to the sensed temperature of receiver 24.

As is shown in the embodiment of FIG. 8, shield 132 can have optional seals 168 to seal between shield 132 and at least one of support structure 110 and face 106 of printheads 100. Seals 168 can be located to further restrict the transport of vaporized carrier fluid near printhead 100 and support structure 110 and can be positioned along a perimeter of a shield 132. Such seals 168 should also be provided in the form of thermal insulators and in that regard, in one embodiment the thermally insulating separator 160 can be arranged to provide a sealing function.

The embodiment of FIG. 8 further illustrates another embodiment of an energy source 180 that uses an intermediate material to heat shield 132. In this embodiment, energy source 180 supplies energy to a heater 182 that heats air that is fed into second region 136 by a blower 184 to heat both ink droplets 102 and shield 132. It will be appreciated that the amount of air fed in this manner will be limited so as not to disturb the travel of ink droplets 102.

Figure 9:
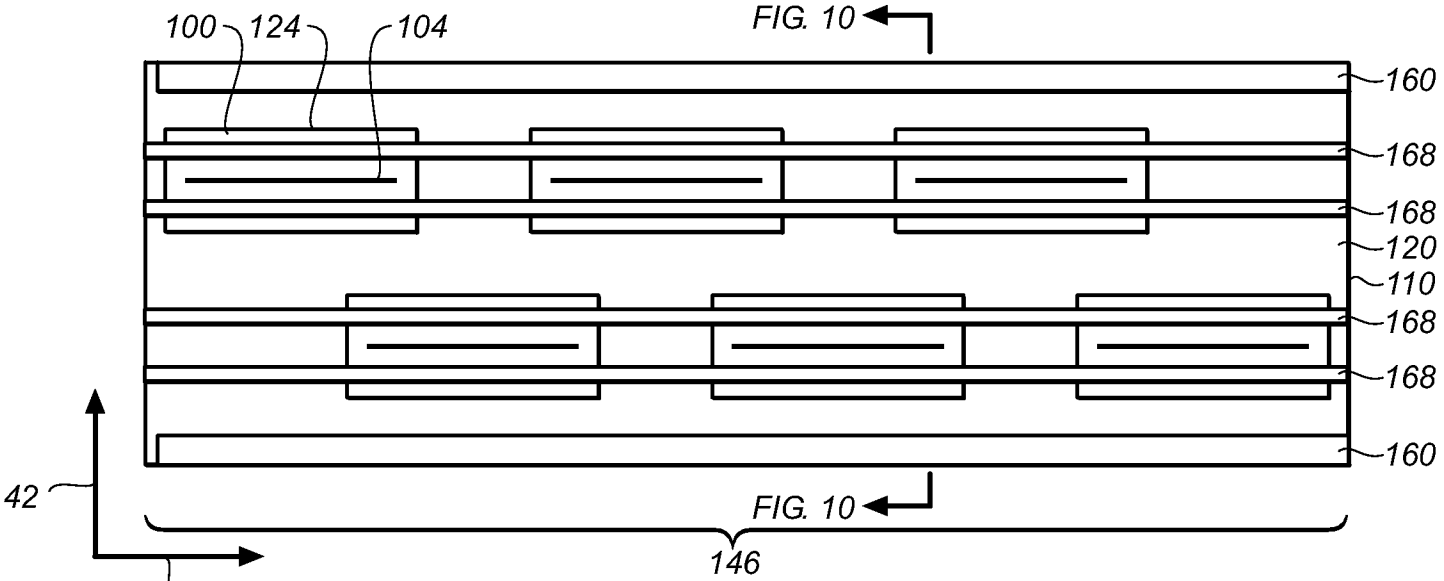
FIGS. 9, 10 and 11 illustrate another embodiment of a condensation control system for an inkjet printing system.

FIG. 9 illustrates a view of a face 120 of a support structure 110 having one possible arrangement of thermally insulating separators 160 and seals 168 that are positioned to support a shield (not shown in FIG. 9) of the type that is illustrated in FIG. 8. In this embodiment, six inkjet printheads 100 are located in separate mountings 124 to provide a continuous range of positions 146 as is generally described above with reference to FIG. 8.

Figure 10:
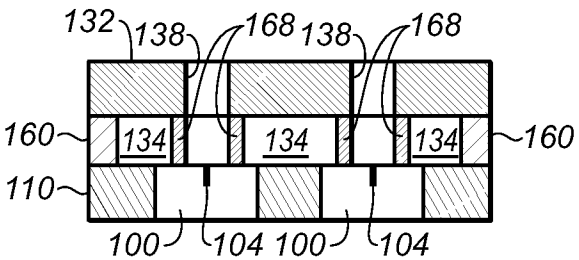

FIG. 10 illustrates a cross section of the support structure 110, thermally insulating separators 160, seals 168 as shown in FIG. 9, with shield 132 attached thereto. As is shown in FIG. 10, when shield 132 is attached, seals 168 form barriers that are generally aligned with openings 138 in shield 132. This forms paths 170 through which nozzles 104 can eject ink droplets (not shown). This also creates first regions 134 that extend across width axis 128 of face 120 of support structure 110 and that are, as shown in this embodiment, generally sealed off from paths 170 such that flow of air or another gas can be supplied across face 120 to help to control condensation at face 120.

Figure 11:
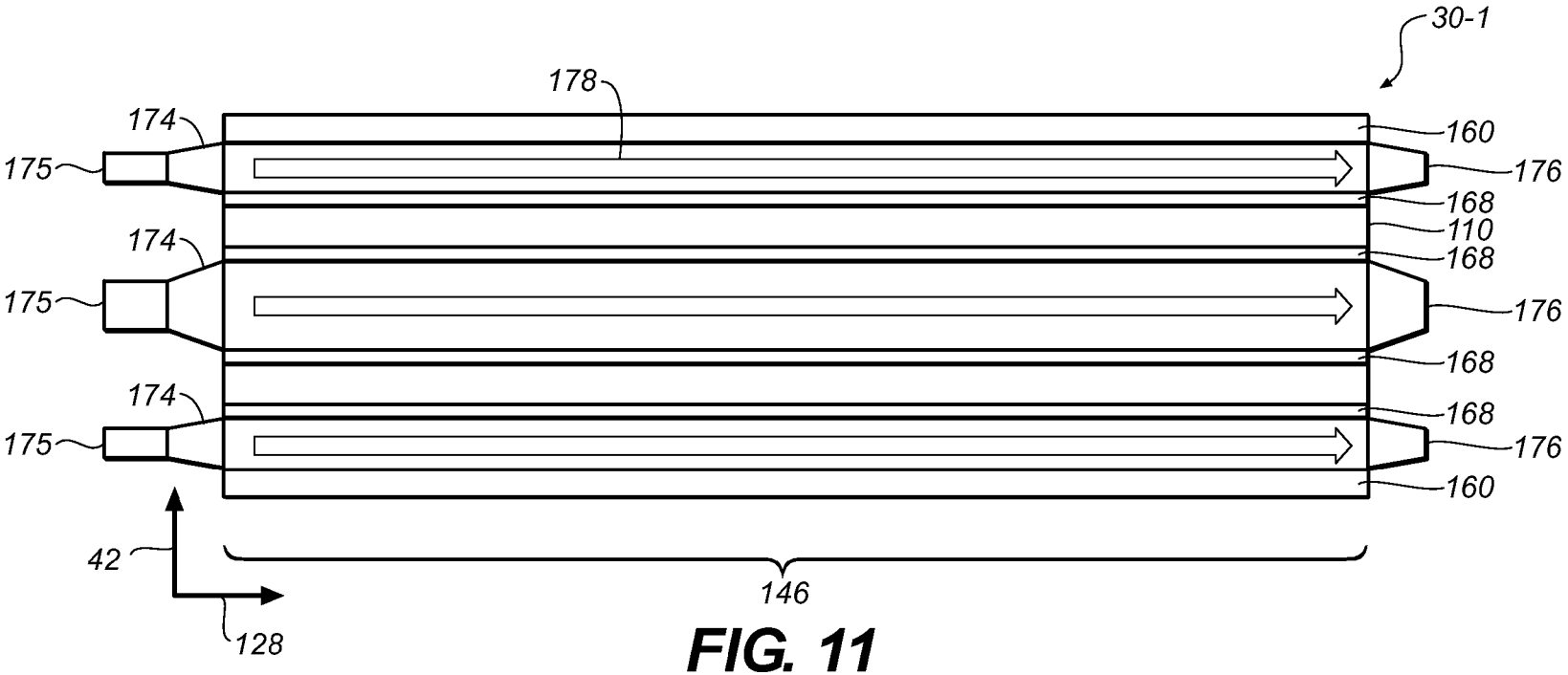

Accordingly, as is schematically illustrated in FIG. 11, at least one of a first region blower 174 and a first region vacuum source create a flow 178 of air or another gas across face 120 through first areas 134. This can be done to limit condensation or to reduce heating of face 120 of support structure 110 by heated shield 132. Optionally one or more conditioning units 175 can be used process the air or other gas in flow 178 to cool, dehumidify or otherwise provide air or another gas that are conditioned to achieve better condensation control.

It will be appreciated that other embodiments of such a condensation control system 318 are possible. In one embodiment, seals 168 are not provided between first areas 134 from second regions 136. This embodiment advantageously allows flow 178 to help purge first region 134 of at least some of any vaporized carrier fluid and any condensate that might enter first region 134 from second region 136. However, when the latter embodiments are used, care must be taken to limit the extent to which flow 178 can impinge upon and influence the path taken by the ink jet droplets.

Figure 12:
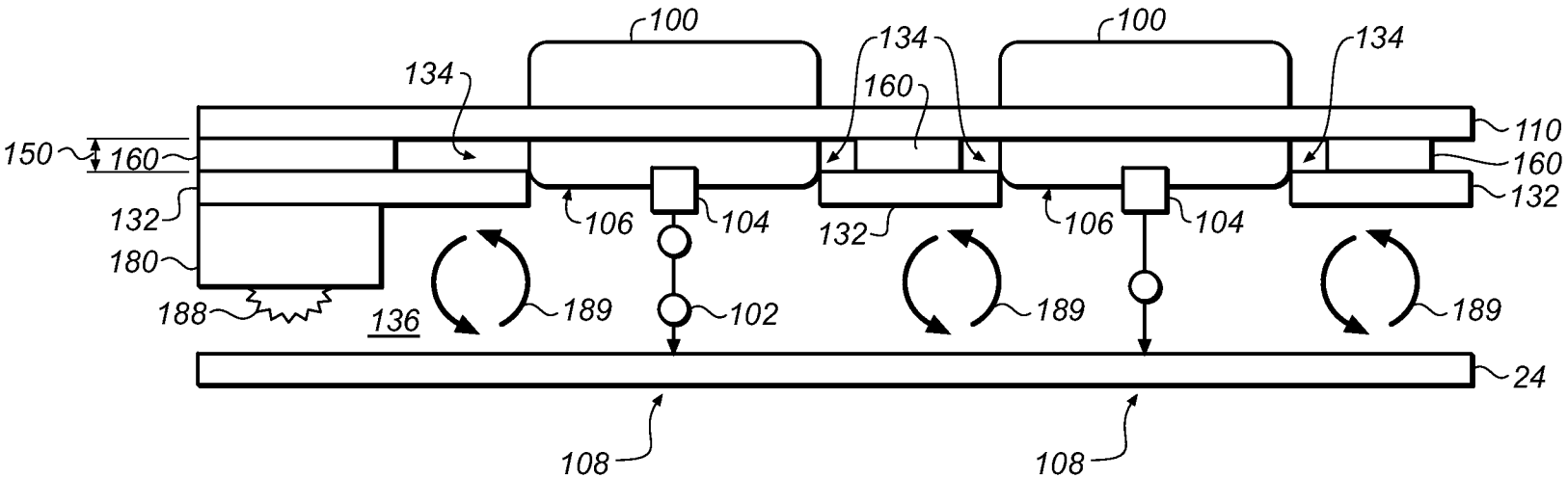
FIG. 12 shows still another embodiment of a condensation control system for an inkjet printing system.

FIG. 12 illustrates another embodiment of a condensation control system for an inkjet printer 20. In this embodiment, printheads 100 each have a face 106 that extends from face 120 of support structure 110 by a projection distance 152 and shield 132 is positioned apart from face 120 by a separation distance 150 that is less than the projection distance 152 of printheads 100. This separates a first region 134 from a second region 136. Here openings 138 are sized to receive inkjet printheads as they project from face 120. The openings allow ink droplets to pass to target area 108 from inkjet printheads 100 while still providing a thermally insulating barrier between shield 132 and support structure 110 as well as a barrier against vaporized carrier fluid. Preferably openings 138 are sealed or substantially sealed to protect against carrier fluid vapor reaching the support structure 110. Here energy source 180 is shown applying an energy 188 to heat receiver 24 causing receiver 24 to heat air in second region 136 to create convection 189 that heats shield 132.

Figure 13:
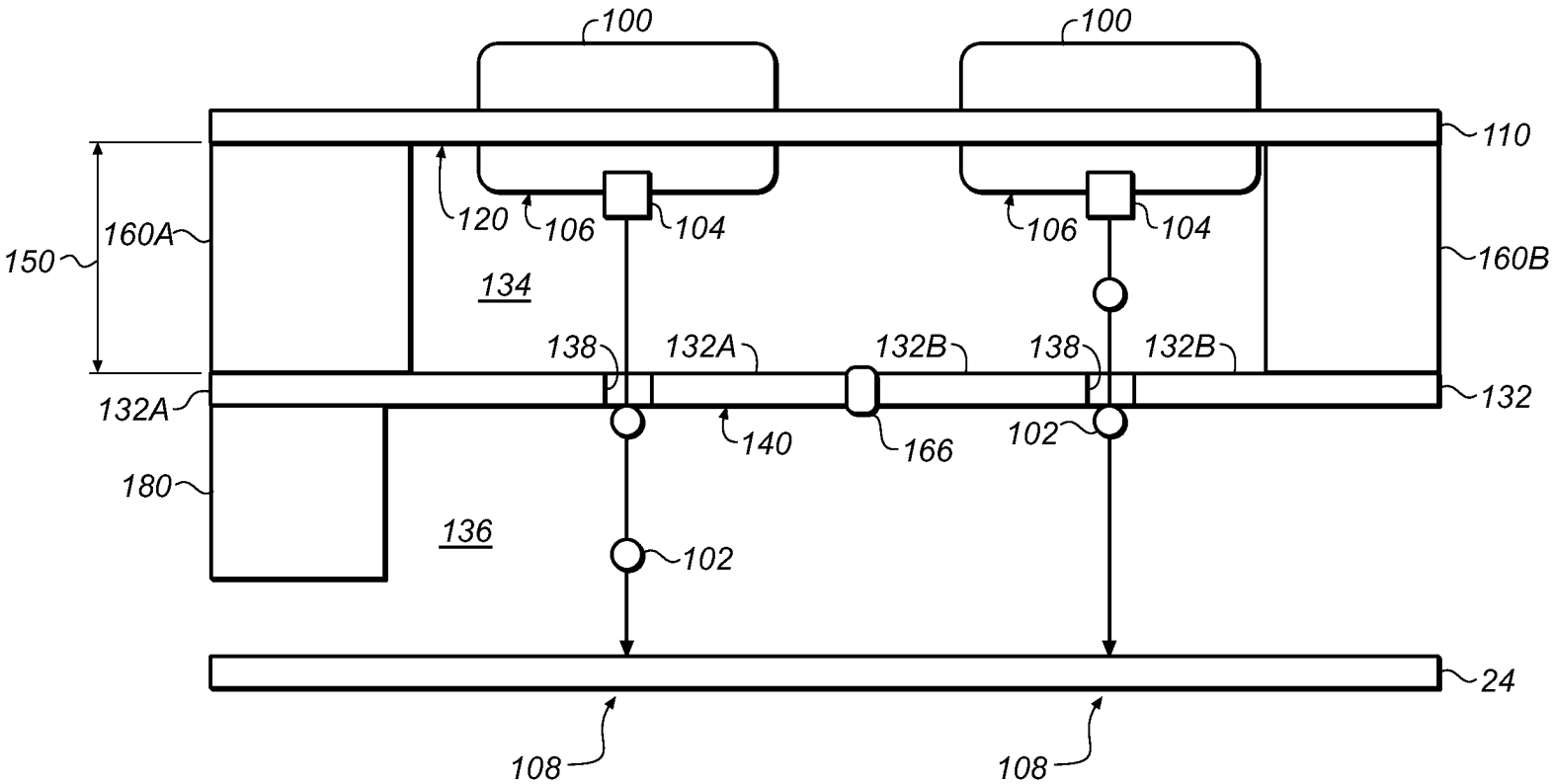
FIG. 13 shows a further embodiment of a condensation control system for an inkjet printing system.

FIG. 13 shows another embodiment of a condensation control system for an inkjet printing system 20. As is shown in this embodiment, condensation control system 118 has a multi-part shield arrangement with shield 132 and thermally insulating separators 160 being provided in the form of multiple parts, a first shield part 132A supported by a first thermally insulating separator 160A and a second shield part 132B supported by a second thermally insulating separator 160B. The different shield parts 132A and 132B can have corresponding or different responses to energy and can be controlled by a common control signal or a shared energy supply or by individual control signals or energy supplies.

In the embodiment that is illustrated in FIG. 13, parts 132A and 132B are optionally linked by way of an expansion joint 166 that allows shield parts 132A and 132B to expand and to contract with changes in temperature without creating significant stresses at thermally insulating separator 160A or thermally insulating separator 160B and without creating an opening therebetween to allow vaporized carrier fluid into such an opening. Here expansion joint is illustrated generally as an expandable material interposed between first shield part 132A and second shield part 132B. In one embodiment of this type expansion joint 166 comprises a stretchable tape that allows first part 132A to separate from second part 132B while maintaining a seal. In still another embodiment, shield 132 can comprise a flexible or bendable sheet that is held in tension by the thermally insulating separator 160 with the thermally insulating separator 160 acting as a frame. In a further embodiment shield 132 can be stretchable to accommodate changes in dimension of the support structure 110 or inkjet printheads 100 due to heating or cooling.

Figure 14:
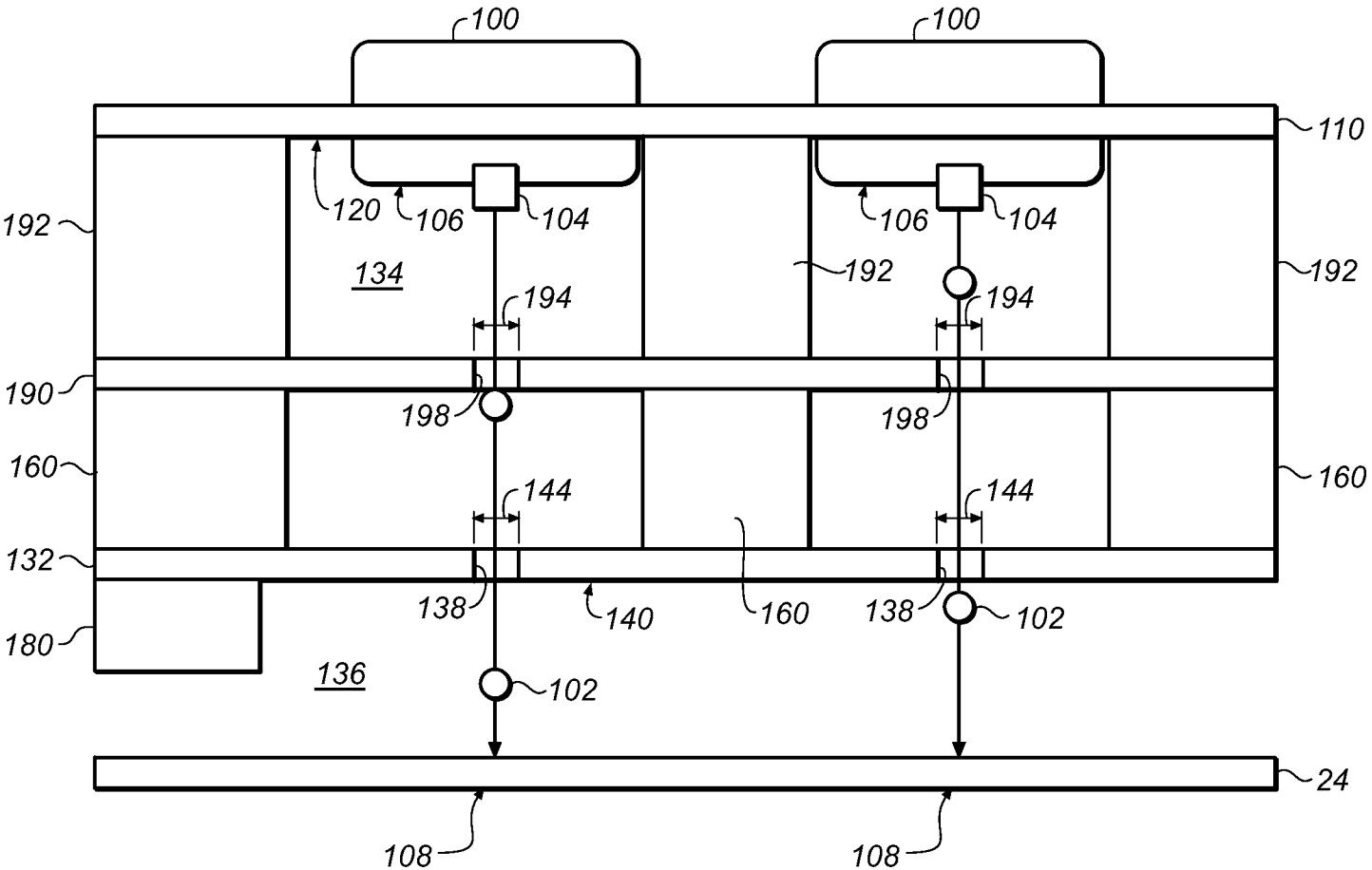
FIG. 14 shows an additional embodiment of an apparatus for controlling condensation.

FIG. 14 shows another embodiment of a condensation control system for an inkjet printing system 20. As is shown in this embodiment, condensation control system 118 has an intermediate shield 190 to define an intermediate region 196 joined to first region 134 by way of an intermediate opening 198 through which the ink droplets 102 can be jetted. The intermediate shield 190 has an intermediate opening 198. Here two such intermediate openings 198 are shown that correspond to two openings 138 in shield 132. In one embodiment, intermediate openings 198 can match to openings 138 such as by having a smallest dimension 194 for intermediate opening 198 that is substantially similar to a smallest cross-sectional distance 144 of opening 138 in shield 132. Alternatively, the shapes and sizes of intermediate openings 198 in intermediate shield 190 can be a different size or shape of openings 138 in shield 132. In one embodiment, the one or more intermediate openings 198 can be shaped or patterned to correspond to an arrangement of nozzles 104 in an inkjet printing module such as inkjet printing module 30-1. The intermediate opening 198 in intermediate shield 190 also can be defined independent of the opening 138 in shield 132 in the same manner as described above.

Figure 15:
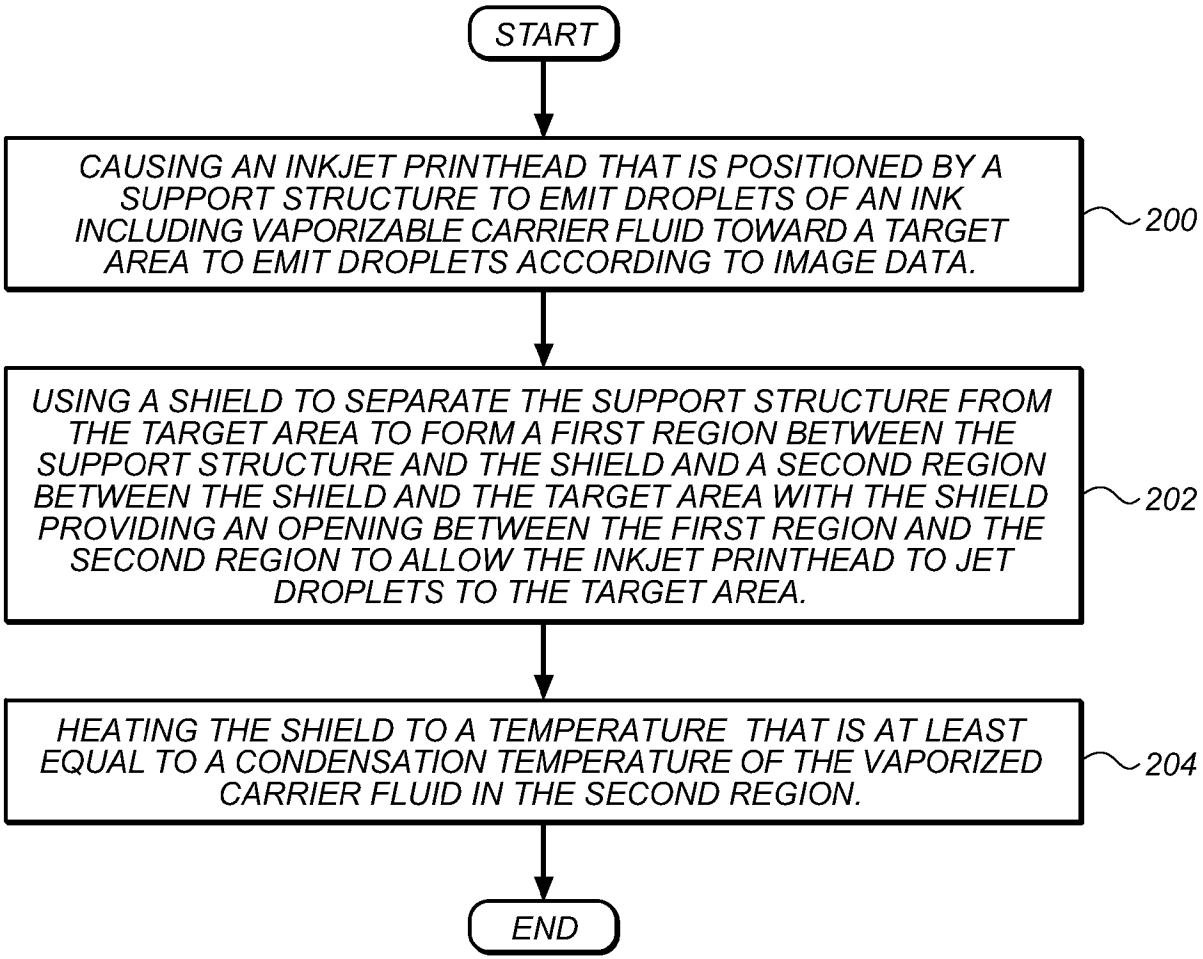
FIG. 15 is a flow chart of one embodiment of a condensation control method.

A method for operating a printing system is provided in FIG. 15. In the embodiment of FIG. 15, an inkjet printhead 100 is positioned by a support structure 110 to jet ink droplets 102 of an ink including vaporizable carrier fluid toward a target area is caused to jet a pattern of ink droplets 102 according to image data (step 200). A shield is used to separate the support structure from the target area to form a first region between the support structure and the shield and a second region between the shield and the target area with the shield providing an opening between the first region and the second region to allow the inkjet printhead to jet droplets to the target area (step 202) and the shield is heated to temperature that is at least equal to a condensation temperature of the vaporized carrier fluid in the second region.

It will be appreciated that the drawings provided herein illustrate arrangements of components of various arrangements components of condensation control system 118. Unless otherwise stated herein, these arrangements are not limiting. For example and without limitation, inkjet printing system 20 is illustrated with sensors 86, energy converting material 172 and energy source 180 being positioned on a face side 140 of shield 132 that confronts second region 136. However, in other embodiments, and unless stated otherwise herein these components can be located on a side 142 of shield 132 that confronts first region 136.

The invention has been described in detail with particular reference to certain preferred embodiments thereof, but it will be understood that variations and modifications can be effected within the spirit and scope of the invention.

What is claimed is:

1. A method for operating a printing system comprising:

causing an inkjet printhead that is positioned by a support structure to emit droplets of an ink including vaporizable carrier fluid toward a target area to emit droplets according to image data;

using a shield to separate the support structure from the target area to form a first region between the support structure and the shield and a second region between the shield and the target area with the shield providing an opening between the first region and the second region to allow the inkjet printhead to jet droplets to the target area, and heating the shield to a temperature that is at least equal to a condensation temperature of the vaporized carrier fluid in the second region.

2. The method of claim 1, wherein portions of the shield are located between portions of the face of the printheads and the target area to limit the extent to which vaporized carrier fluid passes from the second region to the first region.

3. The method of claim 1, wherein the shield has a plurality of openings and wherein the plurality of openings is aligned with the plurality of printheads.

4. The method of claim 1, wherein each printhead has an array of nozzles for jetting the ink droplets and wherein the shield has a plurality of openings aligned with nozzles of each printhead.

5. The method of claim 1, wherein the printheads are continuous inkjet printheads.

6. The method of claim 1, further comprising seals to seal between the shield and the support structure, located adjacent to the perimeter of the shield.

7. The method of claim 1, wherein the shield comprises a sheet of a non-corrosive material.

8. The method claim 1, wherein the shield is one of a polyamide, polyester, vinyl and polystyrene, and polyethylene terephthalate.

9. The method of claim 1, wherein the shield comprises a stainless steel.

10. The method claim 1, wherein the shield is a sheet material that is less than about 1 millimeter in thickness.

11. The method of claim 1, wherein the opening is no more than 20 times larger than the diameter of the ink jet droplets.

12. The method of claim 1, wherein the shield is flexible and is supported by tensioning frame.

13. The method of claim 1, wherein the shield is positioned between the support structure and the target area by a plurality of thermally insulating separators.

14. The method of claim 1, wherein the shield is positioned between the support structure and the target area by a plurality of thermally insulating pins made from at least one of Bakelite, tubular stainless steel and an aerogel.

15. The method claim 1, wherein the shield is heated to a higher temperature away from the one or more openings than proximate to the one or more openings.

16. The method of claim 1, wherein the shield is heated by supplying an energy that an energy converting material on the shield converts into energy and the energy converting material is patterned to cause different portions of the shield to reach heat different in response to the energy.

17. The method of claim 1, wherein the shield is heated by radiating an energy that is absorbed by the shield according to an amount of an absorber on the shield.

18. The method of claim 1, wherein the shield is heated by supplying an electrical energy to resistive elements that are arranged to heat the shield.

19. The method of claim 1, wherein the shield is heated by supplying a flow of a heated medium that contacts the shield and that heats the shield.

20. The method of claim 1, wherein the shield is heated by supplying a heated contact surface that is in contact with the shield to transfer heat to the shield.

21. The method of claim 1, further comprising a sensing a relative humidity sensor positioned in the second region, generating a relative humidity signal that is indicative of as a ratio of the partial pressure of carrier fluid vapor in an air-carrier fluid mixture in the second region to the saturated vapor pressure of a flat sheet of pure carrier fluid at the pressure and temperature of the second region and supplying an amount of energy to heat the shield according to the relative humidity in the second region.

22. The method of claim 1, further comprising sensing liquid condensation on a face of the shield facing the second region and supplying an amount of energy to heat the shield according to the relative humidity in the second region.

23. The method of claim 1, further comprising using an intermediate shield between the first region and the second region to define an intermediate region joined to the first region by way of an intermediate opening through which the ink jet droplets can be jetted.

24. The method of claim 23, wherein the intermediate shield has an intermediate opening that is smaller than the opening in the shield, to further limit the extent to which vaporized carrier fluid travels from the second region into the first region.

25. The method of claim 1, wherein a flow of air is supplied through the first region.

* * * * *